US008511933B2

(12) United States Patent
Menzenbach et al.

(10) Patent No.: US 8,511,933 B2
(45) Date of Patent: Aug. 20, 2013

(54) STABILIZER OR RECYCLER

(75) Inventors: Christoph Menzenbach, Neustadt/Wied (DE); Heiko Bohme, Vettelschoss (DE); Cyrus Barimani, Konigswinter (DE); Gunter Hahn, Konigswinter (DE)

(73) Assignee: Wirtgen GmbH (DE)

( * ) Notice: Subject to any disclaimer, the term of this patent is extended or adjusted under 35 U.S.C. 154(b) by 353 days.

(21) Appl. No.: 12/699,087

(22) Filed: Feb. 3, 2010

(65) Prior Publication Data

US 2010/0209189 A1 Aug. 19, 2010

(30) Foreign Application Priority Data

Feb. 14, 2009 (DE) ..... 10 2009 008 884

(51) Int. Cl.
*E01C 19/18* (2006.01)

(52) U.S. Cl.
USPC ..... 404/108

(58) Field of Classification Search
USPC ..... 404/84.5, 90, 91, 108
See application file for complete search history.

(56) References Cited

U.S. PATENT DOCUMENTS 2,089,094 A * 8/1937 Kime ..... 404/104
2,953,977 A * 9/1960 Warren ..... 404/110

(Continued)

FOREIGN PATENT DOCUMENTS

DE 2518625 A1 11/1976
DE 69103689 T2 2/1995

(Continued)

OTHER PUBLICATIONS

Corresponding EPO Office Action, dated Feb. 14, 2012, 8 pp. (not prior art).

*Primary Examiner* — Thomas B Will
*Assistant Examiner* — Abigail A Risic
(74) *Attorney, Agent, or Firm* — Waddey & Patterson, P.C.; Lucian Wayne Beavers

(57) ABSTRACT

The invention relates to a stabilizer or recycler which has a rotor housing 8, in which a milling/mixing rotor 9 is arranged, and a unit 13 for discharging binder for soil or base material stabilization. In the civil engineering machine according to the invention, at least part of the supply container 14 for the binder, and in particular the part thereof which is of larger volume, is arranged to the rear of the milling/mixing rotor 9 in the direction of working. The center of gravity A of the supply container 14 is preferably arranged to the rear of the axis of rotation 10 of the milling/mixing rotor 9 in the direction of working. This special way in which the supply container is arranged gives an optimum weight distribution. Whereas the supply container 14, which is relatively heavy when filled with binder, is situated mainly to the rear of the milling/mixing rotor 9, the drive unit 12 of the civil engineering machine can be arranged ahead of the milling/mixing rotor. With the supply container and drive unit arranged in this way between the front and rear wheels 3, 4, the center of gravity of the civil engineering machine is situated in the region of the milling/mixing rotor 9, which is something that is aimed for in practice.

33 Claims, 6 Drawing Sheets

(56) References Cited

U.S. PATENT DOCUMENTS

| | | | | |
|---|---|---|---|---|
| 3,519,169 | A * | 7/1970 | Holland | 222/626 |
| 4,473,320 | A | 9/1984 | Register | |
| 4,990,025 | A * | 2/1991 | Young et al. | 404/92 |
| 5,096,125 | A * | 3/1992 | Wise et al. | 239/675 |
| 5,533,829 | A * | 7/1996 | Campbell | 404/81 |
| 5,730,549 | A * | 3/1998 | Choudin et al. | 404/75 |
| 6,050,743 | A | 4/2000 | Medinger | |
| 6,517,281 | B1 * | 2/2003 | Rissi | 404/110 |
| 6,715,702 | B2 * | 4/2004 | McPherson et al. | 239/663 |
| 6,887,013 | B2 * | 5/2005 | Ley et al. | 404/90 |
| 7,441,987 | B1 * | 10/2008 | Sampey | 404/98 |
| 7,918,512 | B2 * | 4/2011 | Mannebach et al. | 299/39.4 |
| 2004/0175234 | A1 | 9/2004 | Wayne | |
| 2007/0286678 | A1 * | 12/2007 | Berning et al. | 404/90 |
| 2010/0239370 | A1 * | 9/2010 | Hill et al. | 404/108 |

FOREIGN PATENT DOCUMENTS

| | | | |
|---|---|---|---|
| DE | 69601736 | T2 | 10/1999 |
| DE | 20221127 | U1 | 2/2005 |
| EP | 0462899 | A1 | 6/1991 |
| EP | 1012396 | B1 | 6/2002 |
| FR | 2743372 | A1 | 7/1997 |
| GB | 1520543 | | 8/1978 |
| WO | 9720109 | A1 | 6/1997 |
| WO | 9914437 | A1 | 3/1999 |

* cited by examiner

STABILIZER OR RECYCLER

Be it known that we, Christoph Menzenbach, a citizen of Germany, residing in Neustadt/Wied, Germany; Heiko Böhme, a citizen of Germany, residing in Vettelschoss, Germany; Cyrus Barimani, a citizen of Germany, residing in Königswinter, Germany; and Güer Hähn, a citizen of Germany, Residing in Königswinter, Germany have invented a new and useful "Stabilizer Or Recycle".

This application claims benefit of German Patent Application DE 10 2009 008 884.9, filed Feb. 14, 2009.

BACKGROUND OF THE INVENTION

1. Field of the Invention

The invention relates to a stabilizer or recycler which has a rotor housing, in which a milling/mixing rotor is arranged, and a unit for discharging binder for soil or base material stabilization.

2. Description of the Prior Art

To improve or consolidate soils or base materials, it is known for a binder in powder form, such as lime or cement for example, to be introduced into the soil or base material to increase the ability to be laid or load-bearing capacity thereof. Typical applications for soil or base material stabilization are the building of roads or railways or surfaces for industrial use.

There are known stabilizers or recyclers by which the binder can both be discharged onto the soil or base material and introduced into the soil or base material directly after being discharged. The introduction of the binder immediately after being discharged has the advantage that the binder cannot be blown away. It is therefore possible for the civil engineering machine to operate with little dust.

Basically, the known stabilizers or recyclers which do not have binder spreaders can be operated in the forward and backward directions. However, stabilizers or recyclers which do have a binder spreader have only one direction of working because the binder is always intended to be discharged ahead of the milling/mixing rotor. Therefore, what will be referred to in what follows is the direction of working of the type of stabilizer or recycler which is fitted with a binder spreader.

The known stabilizers or recyclers have running gear which supports a chassis. The running gear has wheels which are at the front and rear in the direction of working, and the rotor housing which holds the mill/mixing rotor is arranged between these. As well as this, the known stabilizers or recyclers also have a drive unit which comprises not only the driving engine but also other sub-units which are required for driving the civil engineering machine itself and for driving the milling/mixing rotor. These include for example hydraulic pumps to operate hydraulic motors by which the wheels of the self-propelled civil engineering machine are driven.

The unit for discharging the binder of known stabilizers or recyclers has a supply container for the binder and a metering arrangement for metering the binder. There are known stabilizers or binders in which the metering arrangement has one or more rotary feeders of the compartmented rotor type.

A characteristic feature of the known stabilizers or recyclers is that the rotor housing containing the milling/mixing rotor is arranged on the chassis of the machine between the front or rear wheels, the binder being discharged ahead of the milling/mixing rotor in the direction of working. As well as this, another characteristic feature of the known stabilizers or recyclers is that the supply container for the binder is arranged mainly ahead of the milling/mixing rotor in the direction of working.

EP 1 012 396 B1 describes a stabilizer or recycler which has a unit for discharging binders. The funnel-shaped supply container for the binder has a lower sub-section which is arranged between the front wheels and the milling and mixing rotor, and an upper sub-section which is arranged above the milling and mixing rotor. The rotary feeder of the compartmented rotor type for metering the binder is arranged at the outlet of the lower sub-section of the supply container.

SUMMARY OF THE INVENTION

In designing stabilizers or recyclers having a unit for discharging binder, the problem arises of accommodating on the one hand the drive unit for the civil engineering machine and on the other hand the supply container for the binder in or on the chassis of the machine. Factors which play a part in this case are not only the limited physical dimensions of the civil engineering machine but also the weight of the drive unit. Because the supply container is relatively high in weight when filled with binder, the weight distribution of the civil engineering machine is determined mainly by where the supply container is arranged on the chassis of the machine.

When the binder is being discharged, the problem of exact metering arises, because the desired amount spread is intended to be maintained regardless of the speed of travel of the civil engineering machine. In known rotary feeders of the compartmented rotor type which are generally used in stabilizers or recyclers, the compartmented rotor, as it rotates, transports the binder to a drop-through opening from which the binder drops downwards under the prompting of gravity. The rate of flow of the binder depends on the volume of the compartments and how densely filled they are and on the speed of revolution of the compartmented rotor of the rotary feeder which is doing the metering. Metering of high volumetric accuracy presupposes that the density of the bulk material is constant at all times, so that the compartmented rotor is always equally densely filled.

However, with a stabilizer or recycler whose rotary feeder of the compartmented rotor type is arranged below a funnel-shaped supply container, it is not possible to ensure that the compartmented rotor is always equally densely filled as the container empties. For example, when the container is still full, a considerably larger mass of binder rests on the compartmented rotor than when the container is already almost empty, which means that it has to be assumed that the binder is of different densities when the container is still full and when it is almost empty. This can cause inaccuracies in the metering.

The object underlying the invention is to provide a stabilizer or recycler which is of simplified structural design and whose weight distribution is improved.

In a civil engineering machine according to the invention at least part, and in particular the larger part, of the supply container for the binder, i.e. the part of the container of larger volume for receiving the binder, is arranged to the rear of the milling/mixing rotor in the direction of working.

It is not absolutely necessary for the entire supply container to be situated to the rear of the milling/mixing rotor in the direction of working. However, at least that part of the supply container which is of the larger volume should be arranged to the rear of the milling/mixing rotor. A part of the milling/mixing rotor may also be arranged above the milling/mixing rotor in this case. Preferably, the center of gravity of the supply container is arranged to the rear of the axis of rotation of the milling/mixing rotor in the direction of working.

The special way in which the supply container is arranged gives an optimum weight distribution. Whereas the supply container, which is relatively heavy when filled with binder, is situated mainly to the rear of the milling/mixing rotor, the drive unit of the civil engineering machine can be arranged ahead of the milling/mixing rotor. The drive unit may in this case be arranged to the rear of a driver's position arranged at the front end of the civil engineering machine or it may be arranged ahead of a driver's position arranged in the center of the machine. There is enough space available to accommodate all the sub-units of the drive unit in this region of the chassis of the machine ahead of the milling/mixing rotor. The region of the chassis of the machine to the rear of the milling/mixing rotor, which is generally shorter than the region ahead of the milling/mixing rotor, still provides enough space for the supply container to be arranged in this case. Because the weight of the supply container, when filled with binder, is greater than that of the drive unit, the proportions which the parts of the machine ahead of and to the rear of the milling/mixing rotor represent of the length of the machine result in an optimum weight distribution. With the supply container and drive unit arranged in this way between the front and rear wheels, the center of gravity is situated in the region of the milling/mixing rotor, which is something that is aimed for in practice.

Even though the supply container is situated to the rear of the milling/mixing rotor in the civil engineering machine according to the invention, the binder is still discharged ahead of the milling/mixing rotor. The arrangement for the emergence of the binder is therefore arranged ahead of the milling/mixing rotor in the direction of working. The binder may also be discharged into the rotor housing in this case. The arrangement concerned may be an arrangement which is used in general in the known stabilizers or recyclers. The binder may for example emerge from a funnel-shaped enclosure which is fitted with an anti-dust arrangement.

A preferred embodiment of the invention makes provision for the supply container to have an outlet which is provided on a sub-section of the supply container which is at the front in the direction of working. When the supply container is of a funnel-shaped form, the outlet should be situated on an upper sub-section of the supply container. The metering arrangement for metering the binder may be arranged directly below the outlet of the supply container. Because, when the supply container is filled with binder, the column of binder which is situated above an outlet on the upper sub-section of the supply container is, overall, smaller than the column which would be situated above an outlet on the lower sub-section of the supply container, there are smaller variations in the density of the binder which is fed to the metering arrangement. Any variations in the density of the binder which would lead to inaccuracies in metering can therefore be largely ruled out.

To feed the binder to the metering arrangement, the unit for discharging binder preferably has a feeding means by which the binder can be fed even from the bottom sub-section of a funnel-shaped supply container to the upper sub-section thereof.

The feeding means for feeding binder may take different forms. In a preferred embodiment, the feeding means has at least one scraper-flight conveyor which has flights driven by chains or belts to feed the binder. The scraper-flight conveyor has the advantage that the binder can be fed over the entire working width of the civil engineering machine. An alternative embodiment provides one or more feed screws as the feeding means. However, what may be provided in place of scraper-flight conveyors or feed screws is also a pneumatic feeding means or some other feeding means familiar to the person skilled in the art. Such scraper-flight conveyors, feed screws, pneumatic feeding means, and the like, may all be generally referred to as conveyors.

In a further preferred embodiment, the feeding means, such for example as the scraper belt or feed screw, is arranged at least partly inside the supply container so that the feeding means and container form a common sub-assembly.

The supply container preferably takes the form of a funnel-shaped container, thus enabling the binder to collect and be received on the floor of the container. The supply container may for example have a floor which is formed by parts of the body of the container which taper obliquely towards one another and which extend across part of the working width of the machine or the entire working width thereof. However, parts of the side-walls too may taper obliquely towards one another. Basically however, it is also possible for the supply container to have a flat floor.

An embodiment which is a particular preference makes provision for the supply container to have a sub-section at the front in the direction of working which is arranged above the milling/mixing rotor and to have a sub-section at the rear in the direction of working which is arranged above the rear wheels or running-gear units, while a central sub-section extends between the milling/mixing rotor and the rear wheels or running-gear units. The rear section of the supply container may end before the axis of the rear wheels or may also extend to a point beyond the axis of the rear wheels.

The central sub-section of the supply container preferably comprises a lower sub-section which is situated at a relatively low level and in which the binder can collect. Consequently, the container is of a maximum depth in the region between the milling/mixing rotor and the rear wheels or running-gear units and the center of gravity of the supply container is thus situated approximately in this region.

In the embodiment in which the metering arrangement on the supply container is arranged in particular below the outlet of the supply container, the unit for discharging binder has a transporting means to feed the binder leaving the metering arrangement to the arrangement from which the metered binder emerges ahead of the milling/mixing rotor. The binder is preferably fed by gravity. The transporting means may for example be a gravity chute.

An alternative embodiment makes provision for the metering arrangement to be arranged not directly below the outlet of the supply container but at the arrangement for the emergence of the binder. This embodiment has the advantage that the distance which the binder has to cover after being metered out is relatively short, thus enabling a particularly high accuracy of metering to be achieved.

The metering arrangement for metering the binder preferably has at least one rotary feeder of the compartmented rotor type. It is also possible for a plurality of rotary feeders of the compartmented rotor type to be provided which are arranged one behind the other, in the longitudinal direction of the rotary feeders of the compartmented rotor type, across the entire working width of the civil engineering machine. Individual rotary feeders of the compartmented rotor type may also be arranged to be staggered relative to one another in the longitudinal direction of the civil engineering machine in this case. All the rotary feeders of the compartmented rotor type should be capable of being switched on individually. Basically, it is however also possible for the metering of the binder to be performed with means other than one or more rotary feeders of the compartmented rotor type, which other means are known from the prior art.

For the metering arrangement to be fed as evenly as possible, it is of advantage for a means to be provided of distributing the binder in a direction extending transversely to the longitudinal direction of the chassis of the machine. The means of distributing the binder is preferably a distributing screw arranged transversely to the chassis of the machine. It is however also possible for a plurality of distributing screws to be arranged one behind the other in the longitudinal direction of the distributing screws. Individual distributing screws may also be arranged to be staggered relative to one another in the longitudinal direction of the stabilizer or recycler in this case.

Because the supply container for binder is relatively large in volume, which means that its heightwise and/or widthwise dimensions are relatively large, special consent may be needed if the civil engineering machine is to be driven or transported on public roads. An effort is therefore made for the overall height and/or width of the supply container to be as small as possible, though this does limit the use of the civil engineering machine.

Regardless of where the supply container is arranged, this problem is solved by designing the supply container to be a container whose volume is variable. When the supply container is not full of binder, the said container can be reduced to a size at which there is not then any need for consent for transportation. The height and/or width of the machine for transport purposes can be reduced in this way.

In a preferred embodiment of the variable volume supply container, the body of the container comprises a top and a bottom part which can be displaced relative to one another. The connection between the top and bottom body parts may for example be designed after the fashion of a telescope. However, to increase its volume, additional rigid body parts may also be fitted into the supply container, e.g. between the top and bottom body parts.

In an embodiment which is a particular preference, the top and bottom body parts are connected together by a bellows which is compressed together and spread apart like a concertina to respectively reduce and enlarge the volume. Suitable drives may be provided for this purpose such for example as hydraulic or pneumatic drives or electric adjusting motors.

When the stabilizer or recycler is being manufactured, the problem also arises that stabilizers or recyclers are used which do or do not have a binder spreader which has a supply container for the binder. There is however a desire for a retrofittable binder container which can be fitted to an existing platform.

A preferred embodiment of the invention therefore makes provision for the supply container to take the form of a binder tank which can be inserted in the chassis of the machine. The civil engineering machine can thus be supplied with or without a binder tank. The supply container may thus form either an integral part of the chassis of the machine or an exchangeable unit.

An alternative embodiment makes provision for at least part of the walls of the supply container to be formed by parts of the chassis of the machine, and in particular at least parts of the side-walls of the supply container may be formed by parts of the chassis of the machine. At least parts of the front and rear walls of the supply container may also be parts of the chassis of the machine. In this embodiment the top part and/or bottom part of the body of the supply container may take the form of parts which can be fitted to the chassis of the machine, thus enabling the supply container to be produced retrospectively simply by the fitting of the top or bottom parts of the body of the supply container to the existing chassis of the machine. Because parts of the supply container are already parts of the chassis of the machine, relatively few parts are needed for the supply container to be installed.

A number of embodiments of the invention will be described in detail below by reference to the drawings.

DETAILED DESCRIPTION

Figure 1:
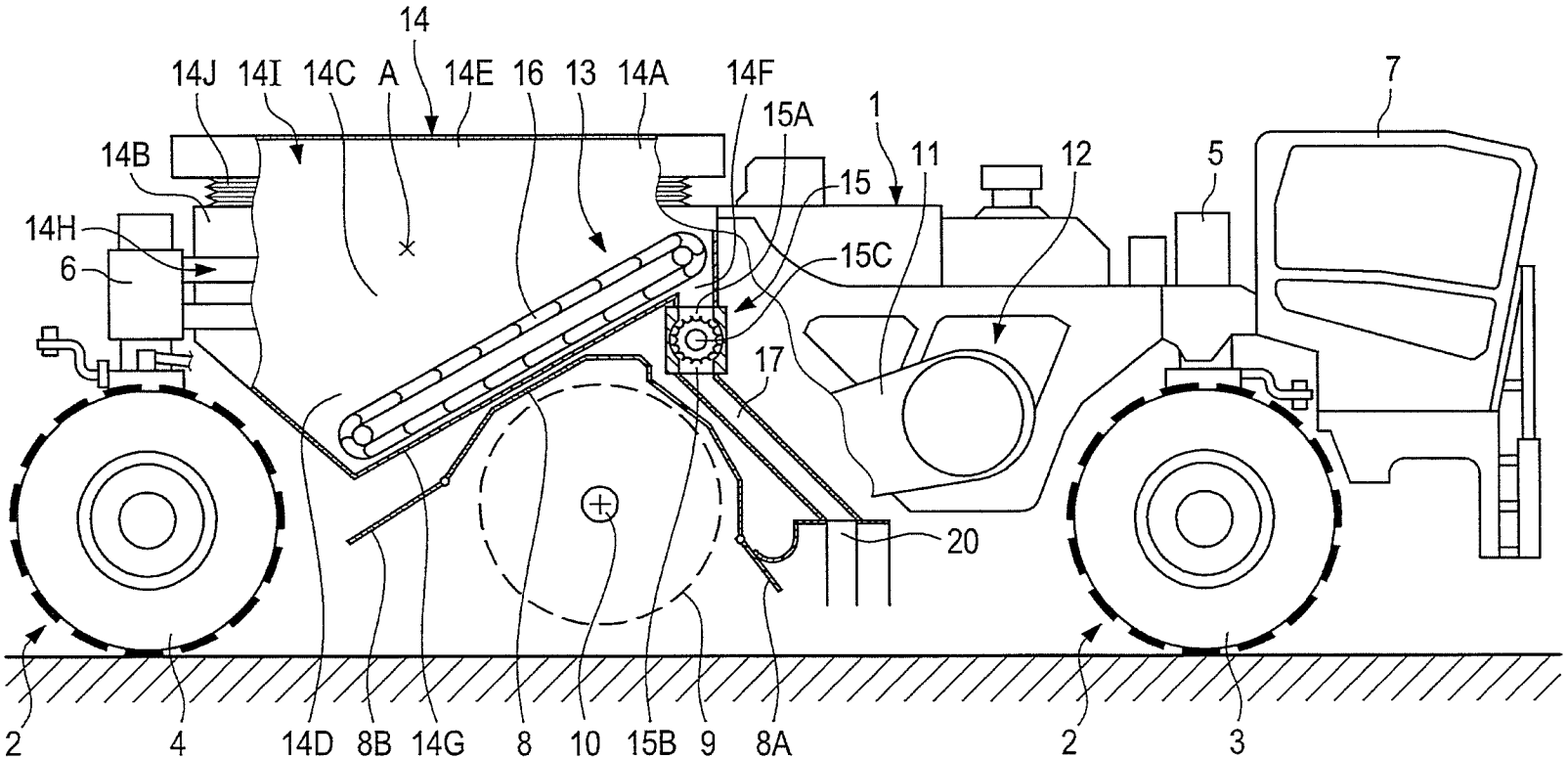
FIG. 1 is a highly simplified schematic view of a first embodiment of self-propelled civil engineering machine according to the invention.

FIG. 1 is a highly simplified schematic view showing the main components of a self-propelled stabilizer or recycler. This civil engineering machine has a chassis 1 which is supported by running gear 2. The running gear 2 has two wheels 3 which are at the front in the direction of working and two wheels 4 which are at the rear in the direction of working, which wheels are fastened to front and rear lifting pillars 5, 6. The front and rear lifting pillars 5, 6, which can be operated independently of one another, are in turn fastened to the chassis 1 of the machine, thus enabling the height of the chassis of the machine relative to the ground to be adjusted. It is also possible for running-gear units, such for example as running-gear units having rubber tracks, to be provided in place of the wheels 3, 4. Either the wheels or the tracks may be generally referred to as running gear units.

In the present embodiment, the driver's position 7 of the stabilizer or recycler is arranged, on the chassis of the machine, ahead of the front wheels 3 in the direction of working (direction of travel). Between the front and rear wheels 3, 4 is a rotor housing 8 in which is arranged a milling/mixing rotor 9 (not shown in detail) which rotates on an axis extending transversely to the longitudinal direction of the chassis 1 of the machine. The milling/mixing rotor may for example be driven mechanically or hydraulically. The milling/mixing rotor is provided with tools (not shown) to enable work to be done on the ground. The rotor housing 8 for the milling/mixing rotor 9, which takes the form of a hood, has adjustable flaps 8A and 8B at the front and rear in the direction of working. To allow the depth of milling to be set, the milling/mixing rotor 9 can be adjusted in the heightwise direction on pivoting arms 11 which are hinged to the chassis 1 of the machine between the front wheels 3 and the milling/mixing rotor 9.

Arranged on the chassis 1 of the machine, to the rear of the driver's position 7 and between the front wheels 3 and the milling/mixing rotor 9 is the drive unit 12 of the stabilizer or recycler, which comprises an internal combustion engine (not shown in detail) and other sub-units, such for example as clutches, hydraulic pumps, etc., which are used to drive the hydraulic motors (not shown) for the front and rear wheels 3, 4 and to drive the milling/mixing rotor 9. All these components are combined into a unit which is situated between the front wheels 3 and the milling/mixing rotor 9. In the event of the driver's position being arranged in the center of the machine, the drive unit is situated ahead of the driver's position in the direction of working.

The stabilizer or recycler according to the invention has a unit 13 for discharging binder in powder form, such as lime or cement for example, which is to be introduced into the soil or base material which is milled up immediately after the milling up.

The unit 13 for discharging binder comprises a supply container 14 to receive the binder, a metering arrangement 15 for metering the binder and an arrangement 20 from which the metered binder emerges above the ground at a point ahead of the milling/mixing rotor 9 in the direction of working. The individual components of the unit 13 for discharging binder will be explained in detail below.

In the present embodiment, the supply container 14 for the binder takes the form of a binder tank which can be inserted in the chassis 1 of the machine. The binder tank thus forms an exchangeable unit.

Whereas the drive unit 12 is arranged on the chassis 1 of the machine ahead of the milling/mixing rotor 9 in the direction of working, the supply container 14 is arranged on the chassis of the machine to the rear of the drive unit in the direction of working. Consequently, the drive unit 12 and supply container 14 are separated from one another in space, thus enabling the individual components of the two units to form respective units in space, which simplifies the structural design.

With regard to its arrangement on the chassis 1 of the machine, the supply container 14 is divided into the following sub-sections. The supply container 14 has a sub-section 14A which is at the front in the direction of working and which is arranged above the milling/mixing rotor 9, and it has a sub-section 14B which is at the rear in the direction of working and which is arranged above the rear wheels 4. The central sub-section 14C of the supply container 14 extends between the milling/mixing rotor 9 and the rear wheels 4. The center of gravity A of the supply container 14 is situated between the milling/mixing rotor 9 and the rear wheels 4 of the stabilizer or recycler, and in particular to the rear of the axis of rotation 10 of the milling/mixing rotor 9.

In the present embodiment, the supply container 14 is a metal container in the form of a funnel which has a lower sub-section 14D in which the walls of the supply container taper towards one another obliquely, and an upper sub-section 14E. At that end of the upper sub-section 14E which is at the front in the direction of working, the supply container 14 has an outlet 14F for the binder.

In the present embodiment, the metering arrangement 15 for metering the binder, which has an inlet 15A and an outlet 15B, is situated directly below the outlet 14F of the supply container 14. The metering arrangement 15 may form a separate sub-assembly, or it may be part of the supply container so that the metering arrangement can be exchanged together with the supply container. The metering arrangement 15 may also be referred to as a metering feeder.

To feed the binder from the floor of the supply container 14 in its lower sub-section 14D to the outlet 14F of the container 14 in its upper sub-section 14E, use is made of a feeding means 16 which is arranged inside the container. In the present embodiment the feeding means 16 is a scraper-flight conveyor which extends across the entire working width of the stabilizer or recycler and by which the binder is fed along the floor part 14G of the supply container 14, which floor part 14G extends obliquely to the direction of working, to the outlet 14F. Scraper-flight conveyors of this kind are part of the prior art.

The scraper-flight conveyor 16 feeds binder continuously to the outlet 14F of the supply container 14, which is situated at a higher level, and the binder then drops into the inlet 15A of the metering arrangement 15. The binder which emerges from the outlet of the metering arrangement 15 is fed by a transporting means 17 to the arrangement 20 from which the metered binder is then sprinkled out onto the ground. The transporting means 17 is a chute which extends downwards obliquely in the direction of working and which connects the outlet of the metering arrangement 15 to the arrangement 20 from which the binder emerges. Instead of one chute, it is also possible for a plurality of chutes to be arranged, distributed transversely to the longitudinal direction of the civil engineering machine. The individual chutes may for example each be formed by a tube or a hose. The arrangement 20 for the emergence of the binder is an enclosure extending across the working width of the machine which is open at the bottom. There may be provided on the enclosure an anti-dust arrangement in the form of hanging flaps, though these are merely indicated. The arrangement 20 for the emergence of binder may also be referred to as a discharge enclosure.

In the present embodiment, the metering arrangement 15 comprises a rotary metering feeder which extends across the working width of the machine and which has a rotating compartmented rotor 15C to meter the binder. Rotary feeders of the compartmented rotor type of this kind are part of the prior art. What may however also be provided rather than one rotary feeder of the compartmented rotor type are a plurality of rotary feeders of the compartmented rotor type which are arranged one behind the other transversely to the direction of working. What may be provided are for example three rotary feeders of the compartmented rotor type which can be operated separately from one another and which each cover a third of the overall width. Rather than three rotary feeders of the compartmented rotor type, one rotary feeder of the compartmented rotor type may also be provided which is fed with binder over only a predetermined part of the working width. The working width may be varied with for example adjustable flaps or metal plates which are able to confine the binder.

Because the present arrangement allows the metering arrangement 15 to be supplied continuously with material to fill it of constant density, a particularly high volumetric accuracy of metering is obtained for the binder.

In the present embodiment, the body of the supply container 14 for the binder comprises a bottom part 14H and a top part 14I which are connected together with a seal by a bellows 14J, thus making the volume of the body of the container variable. FIG. 1 shows the position in which the bellows is compressed together after the fashion of a concertina. When this is the case, the stabilizer or recycler is of only a small overall height.

Figure 2:
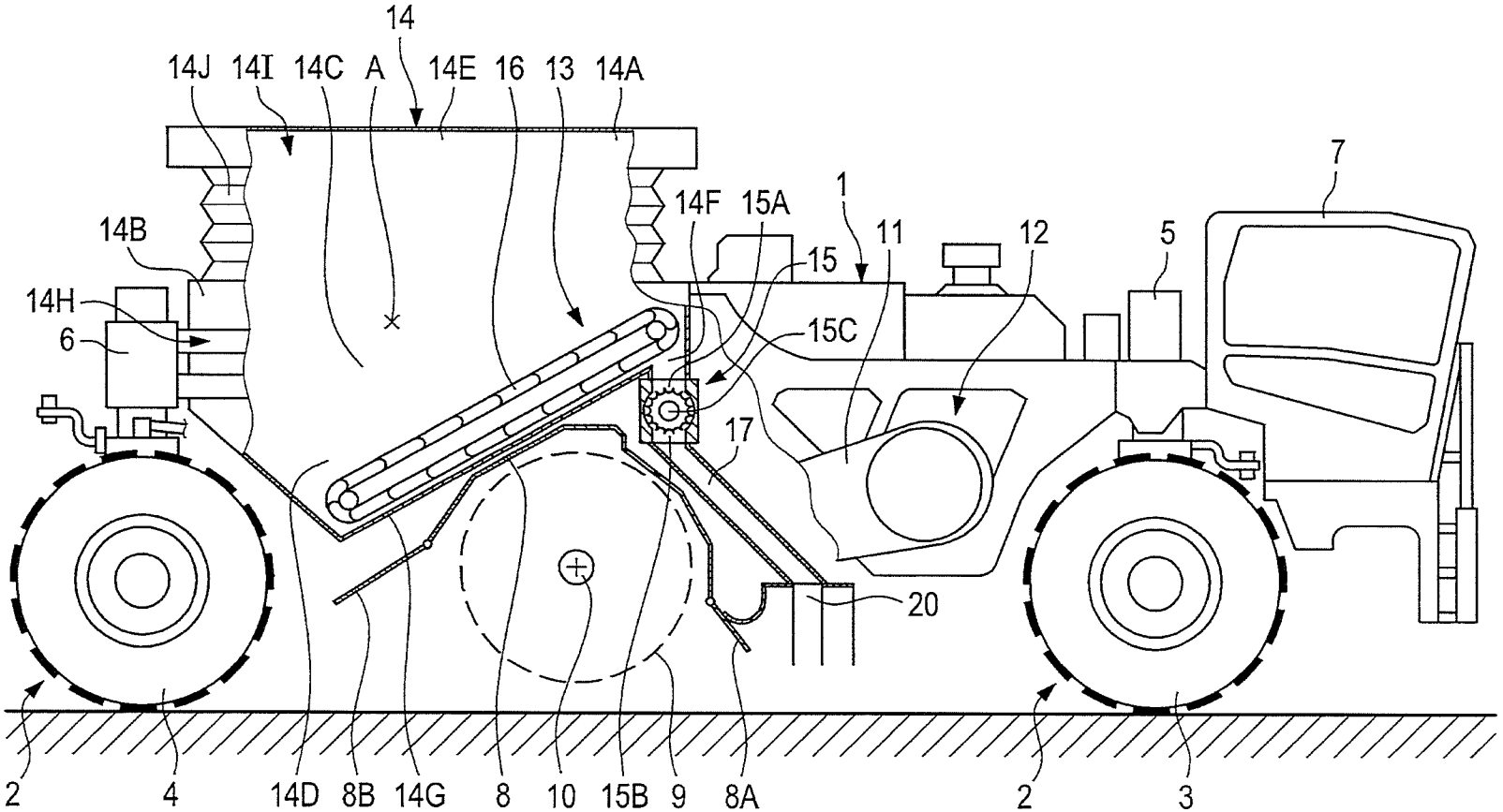
FIG. 2 shows the stabilizer or recycler shown in FIG. 1, with the supply container for the binder extended to increase its volume.

FIG. 2 shows the case where the bellows 14J is extended, thus making available a substantially larger volume of space for the binder. Special consent might have to be obtained for the transport of the civil engineering machine solely because of its height when transported and this may not be necessary when the bellows is collapsed. A volume of space of for example 10 $m^3$ is available for the operation of the machine when the supply container 14 is in the extended position.

Figure 3:
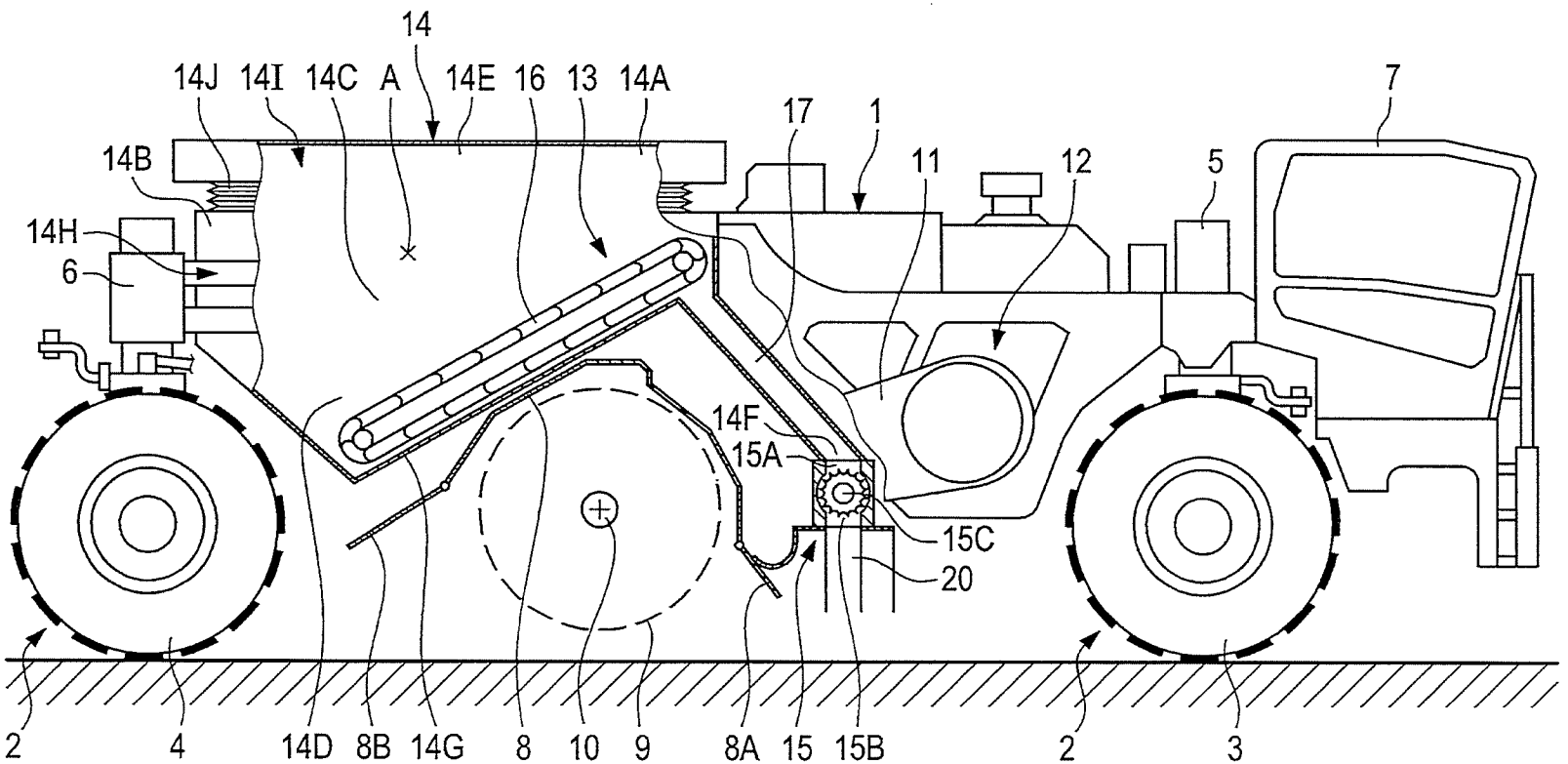
FIG. 3 shows a further embodiment of stabilizer or recycler according to the invention.

FIG. 3 shows an alternative embodiment of stabilizer or recycler according to the invention which differs from the embodiment which has been described by reference to FIGS. 1 and 2 in the arrangement of the metering arrangement 15. Whereas in the embodiment shown in FIGS. 1 and 2 the metering arrangement 15 is situated directly underneath the outlet 14F of the supply container 14, in the embodiment shown in FIG. 3 the metering arrangement 15 is arranged directly above the arrangement 20 from which the binder emerges. Hence the metering arrangement 15 is situated at the bottom end of the gravity chute 17. Otherwise the two embodiments do not differ from one another. Those parts which correspond to one another are therefore also identified by the same reference numerals.

Figure 4:
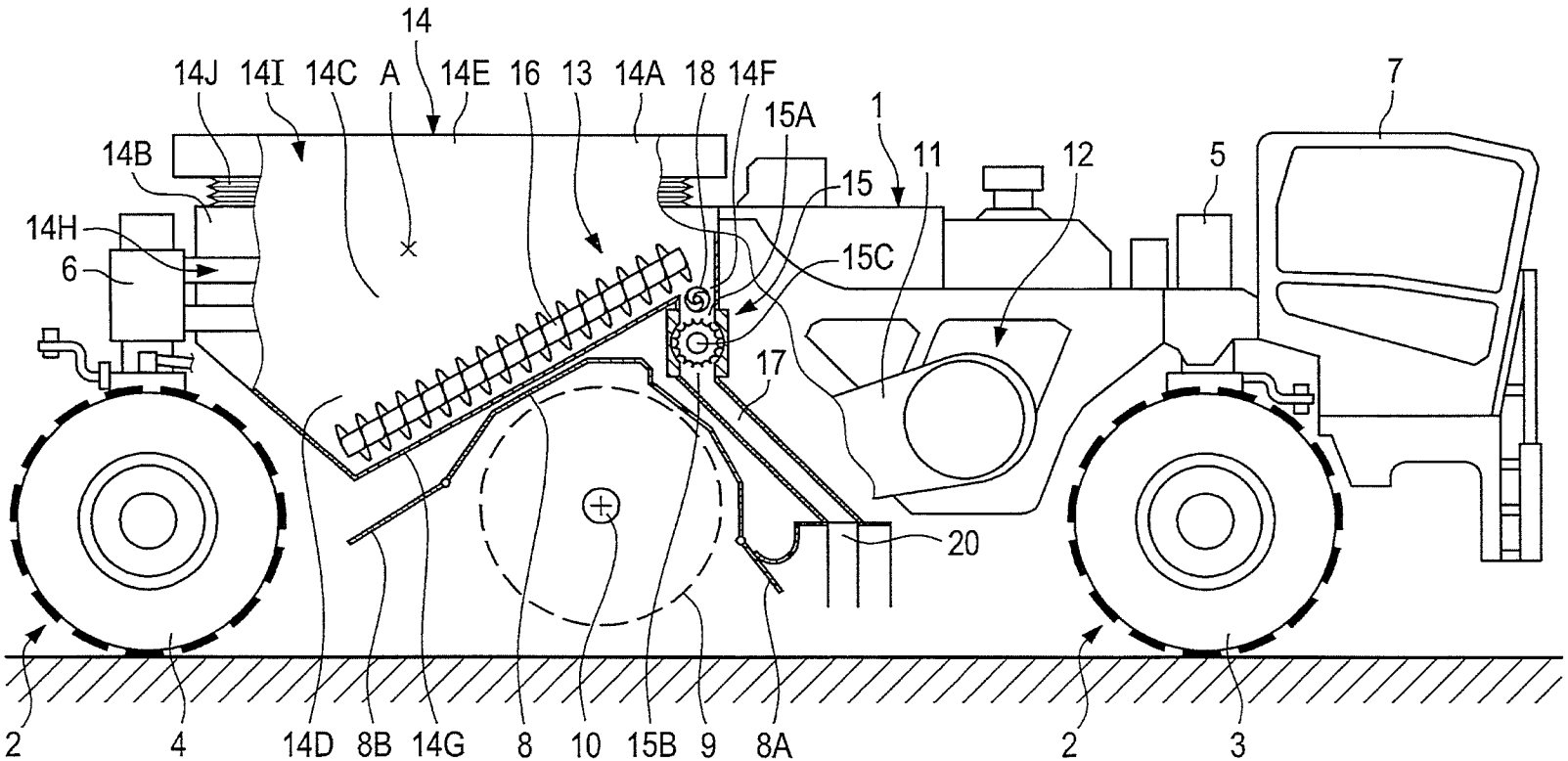
FIG. 4 shows a further embodiment of stabilizer or recycler according to the invention.

FIG. 4 shows a further alternative embodiment of the stabilizer or recycler, which differs from the embodiment which was described by reference to FIGS. 1 and 2 in that a feed screw 16 is provided in place of a scraper-flight conveyor to feed the binder to the outlet 14F of the supply container 14. Feed screws of this kind are familiar to the person skilled in the art. Instead of only one feed screw, it is also possible for a plurality of feed screws to be provided which are arranged to be distributed across the working width of the machine. Because, in contrast to a conveyor belt, binder can be fed over only a limited part of the working width with a feed screw, the alternative embodiment has a means 18 by which the binder dropping from the feed screw 16 can be distributed over the whole of the working width of the civil engineering machine, or over a part of its working width, before it drops into the metering arrangement 15. The arrangement for distributing the binder is preferably a distributing screw 18 which is arranged above the inlet 15A of the metering arrangement 15 and whose longitudinal axis extends transversely to the longitudinal direction of the chassis 1 of the machine. Those parts which correspond to one another are once again identified by the same reference numerals. A means of this kind for distributing the binder in the transverse direction may however also be of advantage in the embodiments which have a scraper-flight conveyor (FIGS. 1 to 3), to obtain a supply to the metering arrangement which is as even as possible across the whole of the working width.

Figure 5:
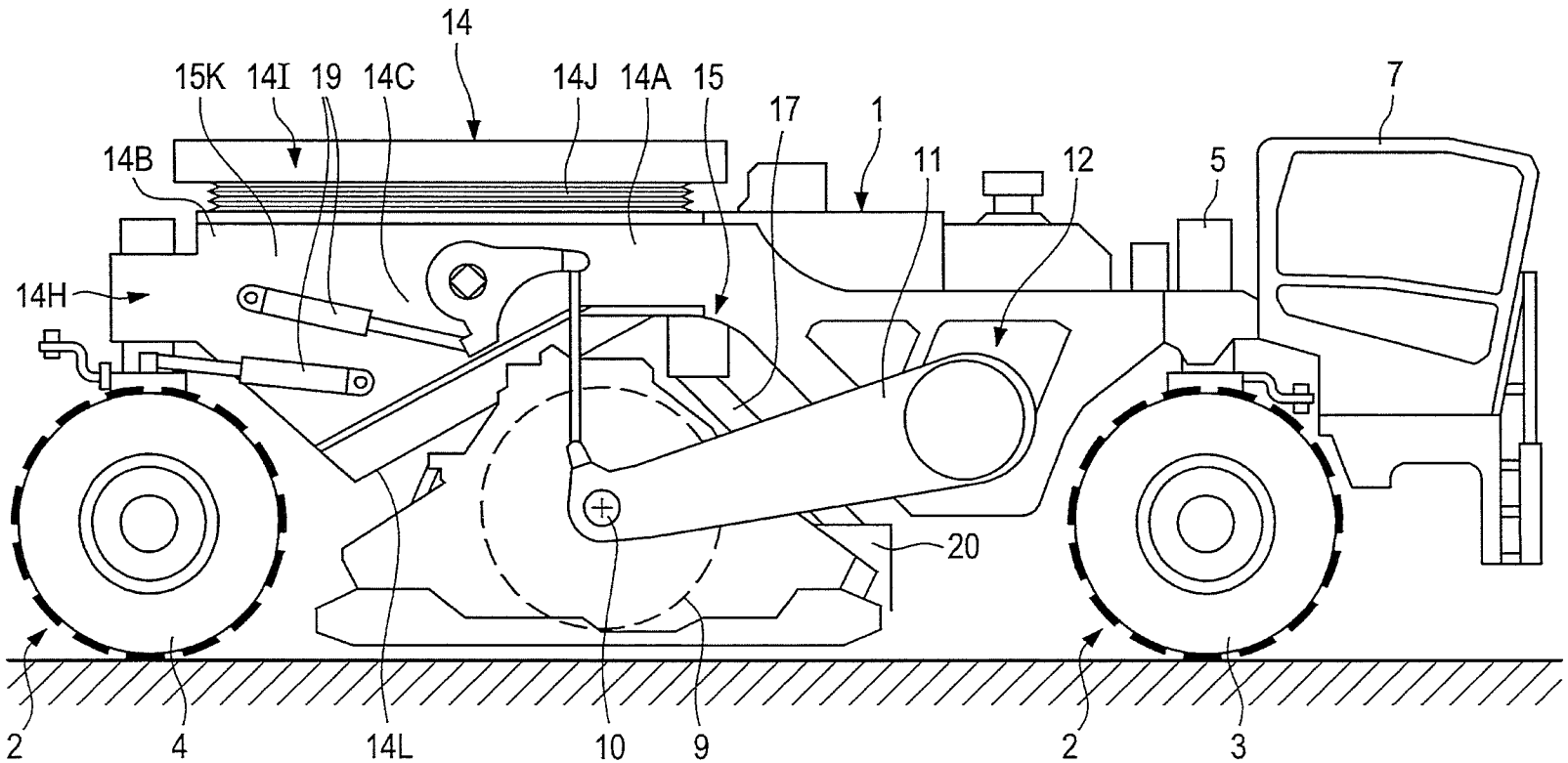
FIG. 5 shows a further embodiment of stabilizer or recycler.

FIG. 5 is a view from the side showing a further embodiment of stabilizer or recycler which differs from the embodiments described above in that the supply container 14 for the binder does not form an exchangeable unit but is an integral part of the chassis 1 of the machine. In this present embodiment, at least part of the bottom part 14H of the body of the supply container 14 is part of the chassis 1 of the machine, the chassis 1 of the machine forming the two side-walls 15K of the bottom part of the body. The front and rear walls of the supply container 14, which cannot be seen in FIG. 5, may also be part of a transverse reinforcing structure of the chassis 1 of the machine.

In the rear part of the stabilizer or recycler, its chassis 1 is so designed that the top part 14I of the body of the container can be placed down on the chassis 1 by the bellows 14J. The top part 14I of the body of the supply container thus forms the lid thereof. At the underside, the chassis of the stabilizer or recycler is so formed in the rear part of the latter that a part 14L of the body of the supply container 14 which forms the floor thereof can be fitted to the side-walls 15K of the chassis. It is possible in this way for civil engineering machines of the kind mentioned to be delivered with or without a supply container.

In the view from the side, FIG. 5 also shows components of the civil engineering machine which cannot be seen in FIGS. 1 to 4, such for example as the hydraulic cylinder arrangements 19, although these are of no significance for the purposes of the present invention.

Figure 6:
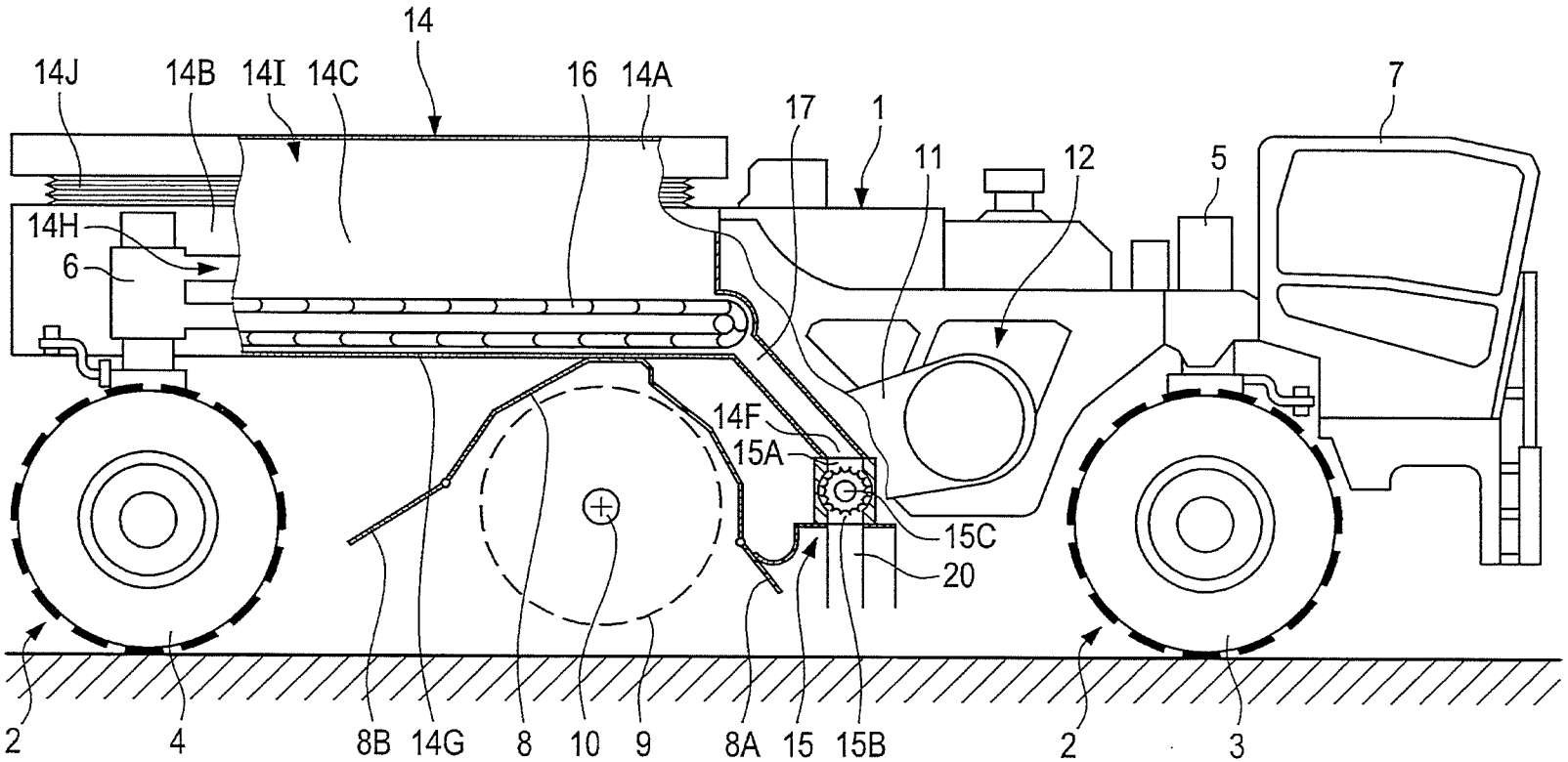
FIG. 6 shows a further embodiment of stabilizer or recycler.

FIG. 6 shows an embodiment of stabilizer or recycler which differs from the embodiments described above in that what the supply container 14 has is not a floor part which extends obliquely in the direction of working but a floor part 14G which is horizontal in the direction of working when the civil engineering machine is standing on horizontal ground. Consequently, in this embodiment the outlet 14F of the supply container 14 is not situated at a higher level than the floor part thereof when the civil engineering machine is standing on horizontal ground. Hence the scraper-flight conveyor 16 too extends in the horizontal direction. The scraper-flight conveyor 16, which extends across the entire working width of the civil engineering machine, feeds the binder continuously to the outlet 14F of the supply container 14, from which the binder drops via the gravity chute 17 into the outlet 15A of the metering arrangement 15, the outlet 15B of which latter is arranged above the arrangement 20 from which the binder finally emerges ahead of the milling/mixing rotor 9. In this respect the embodiment shown in FIG. 6 corresponds to the embodiment shown in FIG. 3. In other respects too the two embodiments do not differ from one another. Those parts which correspond to one another are therefore once again identified by the same reference numerals.

In the embodiment shown in FIG. 6 there may be provided, instead of a supply container 14 having a floor to its body which extends across the entire working width of the civil engineering machine, a supply container the floor of whose body has a flat portion which continues into portions extending obliquely upwards in a direction transverse to the longitudinal direction of the civil engineering machine. In an embodiment of this kind, what suggests itself for use as a feeding means 16 rather than a scraper-flight conveyor is a feed screw which extends in the longitudinal direction of the machine above the flat portion of the floor.

What is claimed is:

1. A stabilizer or recycler machine having running gear which supports a chassis and which has front running-gear units which are at the front in a direction of working and rear running-gear units which are at the rear in the direction of working, having a rotor housing which is arranged on the chassis of the machine between the front and rear running-gear units and in which a milling/mixing rotor is arranged, having a drive unit which is arranged on the chassis of the machine, and having a unit for discharging binder for soil or base material stabilization which has: a supply container for the binder, a metering arrangement for metering the binder, and an arrangement for the emergence of the metered binder which is arranged ahead of the milling/mixing rotor in the direction of working, characterized in that at least part of the supply container for the binder is arranged to the rear of the milling/mixing rotor in the direction of working, and characterized in that the supply container includes all binder container space on the apparatus upstream of the arrangement for metering the binder and the supply container includes a center of gravity of all of the binder container space on the apparatus upstream of the arrangement for metering the binder arranged to the rear of the axis of rotation of the milling/mixing rotor in the direction of working.

2. The stabilizer or recycler according to claim 1, characterized in that the drive unit is arranged on the chassis of the machine ahead of the milling/mixing rotor in the direction of working.

3. The stabilizer or recycler according to claim 1, characterized in that the unit for discharging binder has a feeder arranged to feed binder to the metering arrangement.

4. The stabilizer or recycler according to claim 3, characterized in that the supply container has an outlet for the binder on a sub-section of the supply container which sub-section is at a front of the supply container in the direction of working, the outlet being located higher than a lowest floor of the supply container, and the feeder is arranged to feed binder upward to the outlet of the supply container.

5. The stabilizer or recycler according to claim 4, characterized in that the feeder is arranged at least partly in the supply container.

6. The stabilizer or recycler according to claim 4, characterized in that the feeder has at least one scraper-flight conveyor or at least one feed screw.

7. The stabilizer or recycler according to claim 1, characterized in that a front sub-section of the supply container which is at a front of the supply container in the direction of travel is arranged above the milling/mixing rotor, a rear sub-section of the supply container which is to a rear in the direction of working is arranged above the rear running-gear units, and a central sub-section of the supply container extends between the milling/mixing rotor and the rear running-gear units.

8. The stabilizer or recycler according to claim 1, characterized in that the metering arrangement is arranged on the supply container.

9. The stabilizer or recycler according to claim 1, characterized in that the metering arrangement is arranged on the arrangement for the emergence of the binder.

10. The stabilizer or recycler according to claim 4, characterized in that the unit for discharging binder has a transporter arranged to transport the binder from the outlet of the supply container in a forward direction to the arrangement for the emergence of the binder.

11. The stabilizer or recycler according to claim 1, characterized in that the unit for discharging binder has a distributor arranged to distribute the binder in a direction extending transversely to a longitudinal direction of the chassis of the machine.

12. The stabilizer or recycler according to claim 1, characterized in that the supply container has a variable volume.

13. The stabilizer or recycler according to claim 1, characterized in that the supply container comprises a binder tank which can be inserted in the chassis of the machine.

14. The stabilizer or recycler according to claim 1, characterized in that a body of the supply container has a top part and a bottom part which are connected together by a bellows.

15. The stabilizer or recycler according to claim 1, characterized in that the supply container has walls and at least parts of the walls of the supply container are formed by a part of the chassis of the machine.

16. The stabilizer or recycler according to claim 15, characterized in that the supply container includes side-walls and a body and at least parts of the side-walls of the supply container are formed by a part of the chassis of the machine, the body of the supply container having a top part and/or a bottom part which take the form of parts which can be fitted to the chassis of the machine.

17. A stabilizer or recycler apparatus, comprising:

a chassis having a direction of working defining relatively forward and rearward locations on the apparatus;

one or more forward running-gear units supporting the chassis from a ground surface;

one or more rearward running-gear units supporting the chassis from the ground surface;

a rotor supported from the chassis between the forward and rearward running-gear units for engaging the ground surface;

a drive unit supported on the chassis;

a supply container for containing binder for soil or base material stabilization, at least part of the supply container being located rearward of the rotor;

a discharge enclosure located forward of the rotor so that binder may emerge from the discharge enclosure and drop onto the ground surface forward of the rotor;

a metering feeder communicated with the supply container and the discharge enclosure to feed binder from the supply container to the discharge enclosure; and wherein the supply container includes all binder container space on the apparatus upstream of the metering feeder, and the supply container has a center of gravity of all of the binder container space on the apparatus upstream of the metering feeder located rearward of an axis of rotation of the rotor.

18. The apparatus of claim 17, wherein the drive unit is located on the chassis forward of the rotor.

19. The apparatus of claim 17, further comprising:

the supply container including a lower portion located lower than the metering feeder; and a supply conveyor communicated with the supply container and the metering feeder to convey binder upwards from the lower portion of the supply container to the metering feeder.

20. The apparatus of claim 19, wherein:

the supply conveyor is located at least partly within the supply container.

21. The apparatus of claim 19, wherein:

the supply conveyor comprises at least one scraper-flight conveyor.

22. The apparatus of claim 19, wherein:

the supply conveyor comprises at least one feed screw.

23. The apparatus of claim 17, wherein:

the supply container includes a forward supply container portion, and includes a supply container outlet defined in the forward supply container portion, the supply container outlet being located higher than a lower portion of the supply container.

24. The apparatus of claim 17, wherein the supply container comprises:

a forward supply container portion located above the rotor;

a rearward supply container portion located above the rearward running-gear units; and a central supply container portion located between the rotor and the rearward running-gear units.

25. The apparatus of claim 23, wherein:

the metering feeder is located on the supply container immediately below the outlet.

26. The apparatus of claim 17, wherein:

the metering feeder is located on the discharge enclosure.

27. The apparatus of claim 17, further comprising:

the supply container having an outlet; and a transport connecting the outlet of the supply container to the discharge enclosure and extending forward from the outlet to the discharge enclosure.

28. The apparatus of claim 17, the metering feeder includes a transverse conveyor to distribute the binder in a direction extending transversely to the direction of travel.

29. The apparatus of claim 17, wherein:

the supply container is adjustable in size to vary a volume of the supply container.

30. The apparatus of claim 29, wherein:

the supply container includes a top part and a bottom part connected together by a bellows.

31. The apparatus of claim 17, wherein:

the supply container includes a binder tank which can be selectively mounted on and removed from the chassis.

32. The apparatus of claim 17, wherein:

the supply container includes walls, and at least parts of the walls are defined by a part of the chassis.

33. The apparatus of claim 32, wherein:

the container includes a body having body parts connected to the chassis.

* * * * *

UNITED STATES PATENT AND TRADEMARK OFFICE

CERTIFICATE OF CORRECTION

PATENT NO. : 8,511,933 B2
APPLICATION NO. : 12/699087
DATED : August 20, 2013
INVENTOR(S) : Menzenbach et al.

It is certified that error appears in the above-identified patent and that said Letters Patent is hereby corrected as shown below:

In the Specification

In column 1, line 7, replace “Güer” with --Günter--;
In column 1, line 8, replace “Residing” with --residing--;
In column 1, line 9, replace “Recycle” with --Recycler--.

Signed and Sealed this
Tenth Day of June, 2014

Michelle K. Lee

Michelle K. Lee
*Deputy Director of the United States Patent and Trademark Office*